US010189148B2

(12) United States Patent
Huang et al.

(10) Patent No.: US 10,189,148 B2
(45) Date of Patent: Jan. 29, 2019

(54) ONE-WAY WRENCH SWITCHABLE BETWEEN TWO MODES

(71) Applicants: Chih-Ying Huang, Taichung (TW); Yong-Ting Liu, Taichung (TW)

(72) Inventors: Chih-Ying Huang, Taichung (TW); Yong-Ting Liu, Taichung (TW)

( * ) Notice: Subject to any disclaimer, the term of this patent is extended or adjusted under 35 U.S.C. 154(b) by 363 days.

(21) Appl. No.: 15/017,589

(22) Filed: Feb. 6, 2016

(65) Prior Publication Data

US 2017/0225304 A1 Aug. 10, 2017

(51) Int. Cl.
*B25B 13/46* (2006.01)
*B25B 13/48* (2006.01)

(52) U.S. Cl.
CPC ..... *B25B 13/467* (2013.01); *B25B 13/466* (2013.01); *B25B 13/481* (2013.01)

(58) Field of Classification Search
CPC ... B25B 13/467; B25B 13/466; B25B 13/481; B25B 17/00
USPC ..... 81/58.1, 58, 58.3, 60, 61, 63.2, 57.39
See application file for complete search history.

(56) References Cited

U.S. PATENT DOCUMENTS 616,540 A * 12/1898 King ..... B25B 13/467 81/58.1
919,260 A * 4/1909 Smith ..... B25B 13/467 105/307
1,970,721 A * 8/1934 Walton ..... B25B 13/467 74/142
3,756,090 A * 9/1973 Melia ..... B25B 13/466 173/216
4,507,989 A * 4/1985 Baker ..... B25B 13/467 81/57.39
4,592,254 A * 6/1986 Wallis ..... B25B 13/467 81/57.39
4,960,015 A * 10/1990 Mathews ..... B25B 13/481 16/429
5,000,066 A * 3/1991 Gentiluomo ..... B25B 13/463 81/62
5,259,259 A * 11/1993 Inokuchi ..... B25B 13/467 192/48.92
7,357,053 B2 * 4/2008 Doan ..... G01B 5/255 81/57.14
2008/0028894 A1 * 2/2008 Maret ..... B25B 13/463 81/60

FOREIGN PATENT DOCUMENTS

FR 2854091 A1 * 10/2004 ..... B25B 13/467

* cited by examiner

*Primary Examiner* — Hadi Shakeri

(57) ABSTRACT

A one-way wrench includes a handle, a toothed wheel, a detent, a rod and a gear train. The handle includes a shank and a head. The head is formed at an end of the shank and includes a chamber in communication with the tunnel. The toothed wheel is rotationally inserted in the chamber of the head. The detent is pivotally connected to the head and elastically engaged with the toothed wheel so that the head rotates the toothed wheel in a one-way manner. The rod is movable in the tunnel of the shank in a reciprocated manner. The gear train is arranged between the rod and the toothed wheel to convert the reciprocating of the rod to on-and-off rotation of the toothed wheel.

15 Claims, 17 Drawing Sheets

ONE-WAY WRENCH SWITCHABLE BETWEEN TWO MODES

BACKGROUND OF INVENTION

1. Field of Invention

The present invention relates to a one-way wrench and, more particularly, to a one-way wrench switchable between two modes.

2. Related Prior Art

U.S. Pat. No. 6,070,499 discloses a one-way wrench switchable between two modes, one for transmitting high torque and the other for transmitting low torque. The one-way wrench includes a handle 11, a rotary member 27, a drive member 13, two pawls 42 and 43, a selector switch 45 and a drive ring 21. A knurled sleeve 12 is provided on a section of the handle 11. The handle 11 includes a fixed arm 14 formed on another section and a driving housing 15 formed at an end. The driving housing 15 includes teeth 17 formed on an internal face. The fixed arm 14 includes a tunnel in communication with the interior of the driving housing 15. The drive member 13 is a stepped element with two slots 39 and 40 for receiving the pawls 42 and 43. A pin 44 is inserted in the drive member 13 and the pawls 42 and 43 to render the pawls 42 and 43 rotatable relative to the drive member 13. The selector switch 45 includes a plate 52 formed at an end of a spindle 46. The spindle 46 includes two holes 55 and 56. The hole 55 receives a spring 49 and a bearing pin 47. The hole 56 receives a spring 50 and a bearing pin 48. As the selector switch 45 is inserted in the drive member 13, the holes 55 and 56 are in communication with the slots 39 and 40, respectively. The spring 49 pushes the bearing pin 47 to bias the pawl 42. The spring 50 pushes the bearing pin 48 to bias the pawl 43. A substantial portion of the drive member 13 is inserted in the driving housing 15 and the drive ring 21 while a portion of the drive member 13 that extends out of the drive ring 21 is engaged with a clip 36. Thus, the drive member 13 and the drive ring 21 are kept on the handle 11 while the drive ring 21 is allowed to spin around the drive member 13. The pawl 42 is engaged with the driving housing 15 while the pawl 43 is engaged with the drive ring 21.

The shaft 24 includes a bevel pinion 25 at an end and a spline projection 27 at another end. A substantial portion of the shaft 24 is inserted in the tunnel of the handle 11 while the bevel pinion 25 is engaged with the drive ring 21 in the driving housing 15 and the spline projection 27 is engaged with the knurled sleeve 12.

The knurled sleeve 12 is maneuvered to spin the shaft 24 relative to the handle 11 in two senses of direction. In the first sense of direction, the bevel pinion 25 spins the drive ring 21 relative to the pawl 43 without spinning the drive member 13 in a direction. The bevel pinion 25 spins the drive ring 21 that in turn spins the drive member 13 via the pawl 43. Thus, the one-way wrench transmits low torque at high speed.

When the handle 11 is pivoted to spin the driving housing 15 while the shaft 24 is not spun relative to the handle 11, the driving housing 15 spins the drive member 13 via the pawl 42. Thus, the one-way wrench transmits high torque at low speed.

Taiwanese Patent Nos. 494828 and 1468261 disclose similar one-way wrenches. However, problems are encountered in the use of these one-way wrenches. Firstly, in the mode for transmitting low torque at high speed, the actual speed for spinning the drive member 13 is low since a user cannot use his or her hand to spin the knurled sleeve 12 for more than 180° without having to stop and turn his or her hand back to the normal position. Secondly, the user could easily injure his or her wrist if he or she twists the knurled sleeve 12 very often.

The present invention is therefore intended to obviate or at least alleviate the problems encountered in prior art.

SUMMARY OF INVENTION

It is the primary objective of the present invention to provide a one-way wrench switchable between a high-torque mode and a high-speed mode which imposes relatively little stress in a user's wrist.

To achieve the foregoing objective, the one-way wrench includes a handle, a toothed wheel, a detent, a rod and a gear train. The handle includes a head formed at an end of a shank. The shank includes a chamber in communication with the tunnel. The toothed wheel is rotationally inserted in the chamber of the head. The detent is pivotally connected to the head and elastically engaged with the toothed wheel so that the head rotates the toothed wheel in a one-way manner. The rod is movable in the tunnel of the shank in a reciprocated manner. The gear train is arranged between the rod and the toothed wheel to convert the reciprocating of the rod to on-and-off rotation of the toothed wheel.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
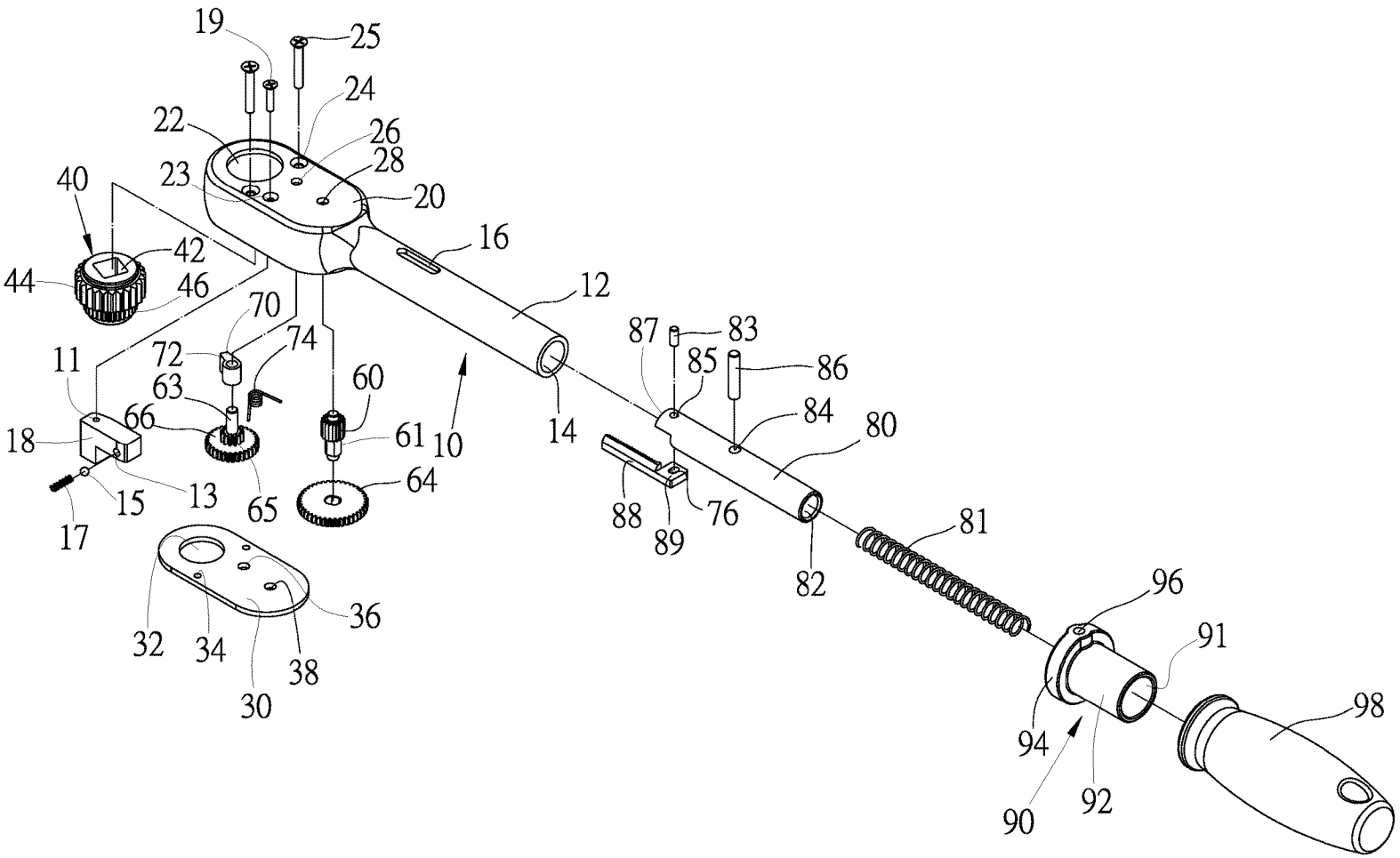
FIG. 1 is an exploded view of a one-way wrench according to the first embodiment of the present invention.

Referring to FIGS. 1 to 11, a one-way wrench includes a handle 10, a cover 30, a toothed wheel 40, a gear train, a detent 70, a rod 80, a spring 81, a driving element 90 and a grip 98 according to a first embodiment of the present invention. The gear train includes elements that will be described later.

Figure 2:
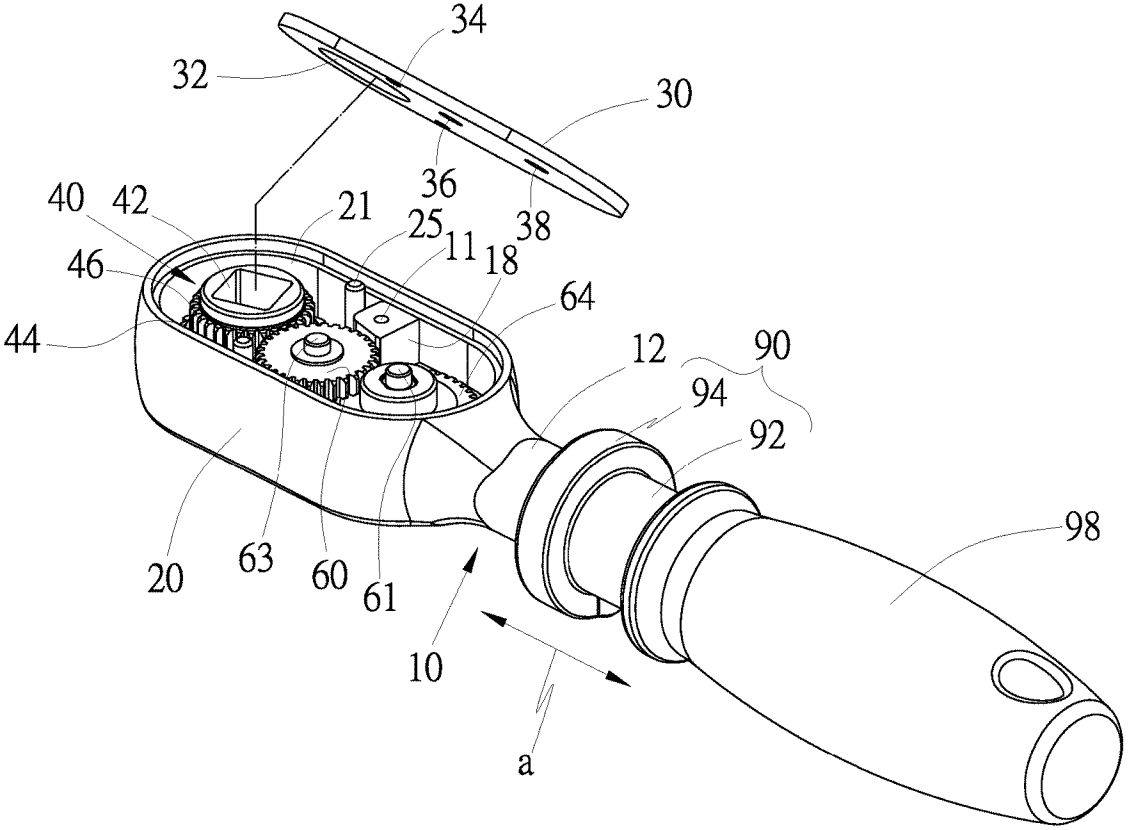
FIG. 2 is a partial view of the one-way wrench shown in FIG. 1.
Figure 3:
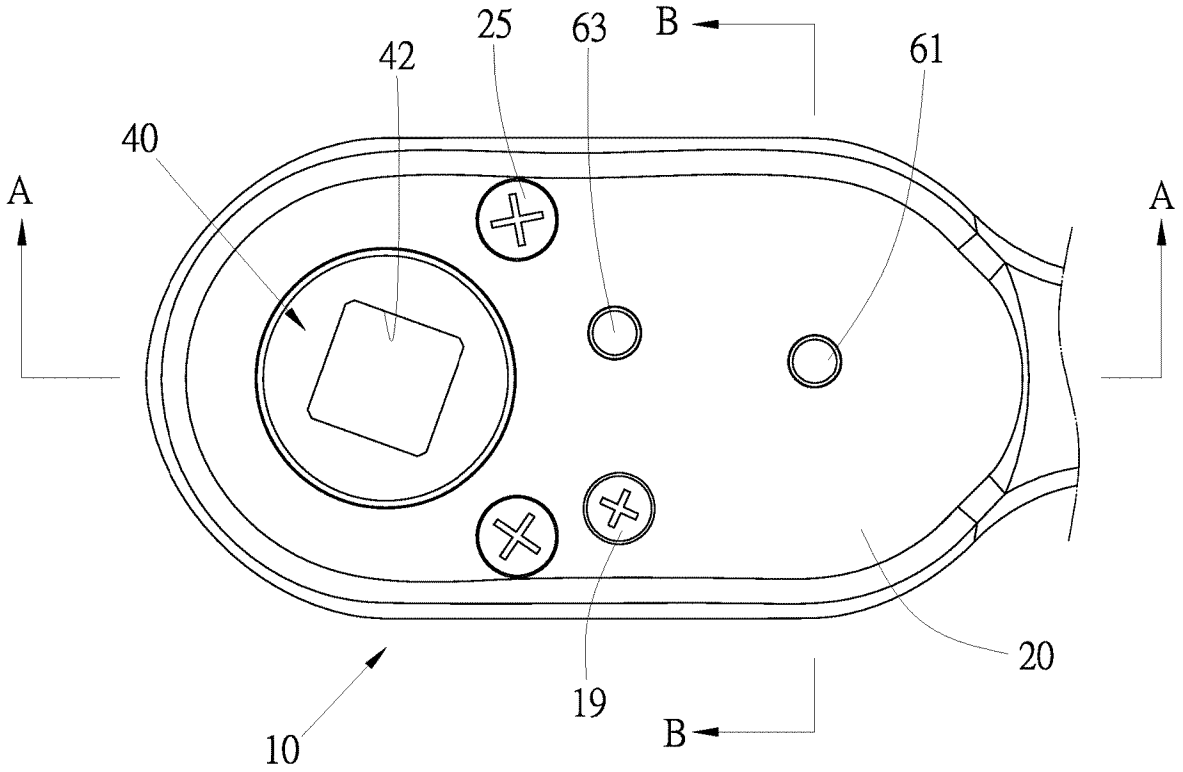
FIG. 3 is a top view of a head of the one-way wrench illustrated in FIG. 1.
Figure 4:
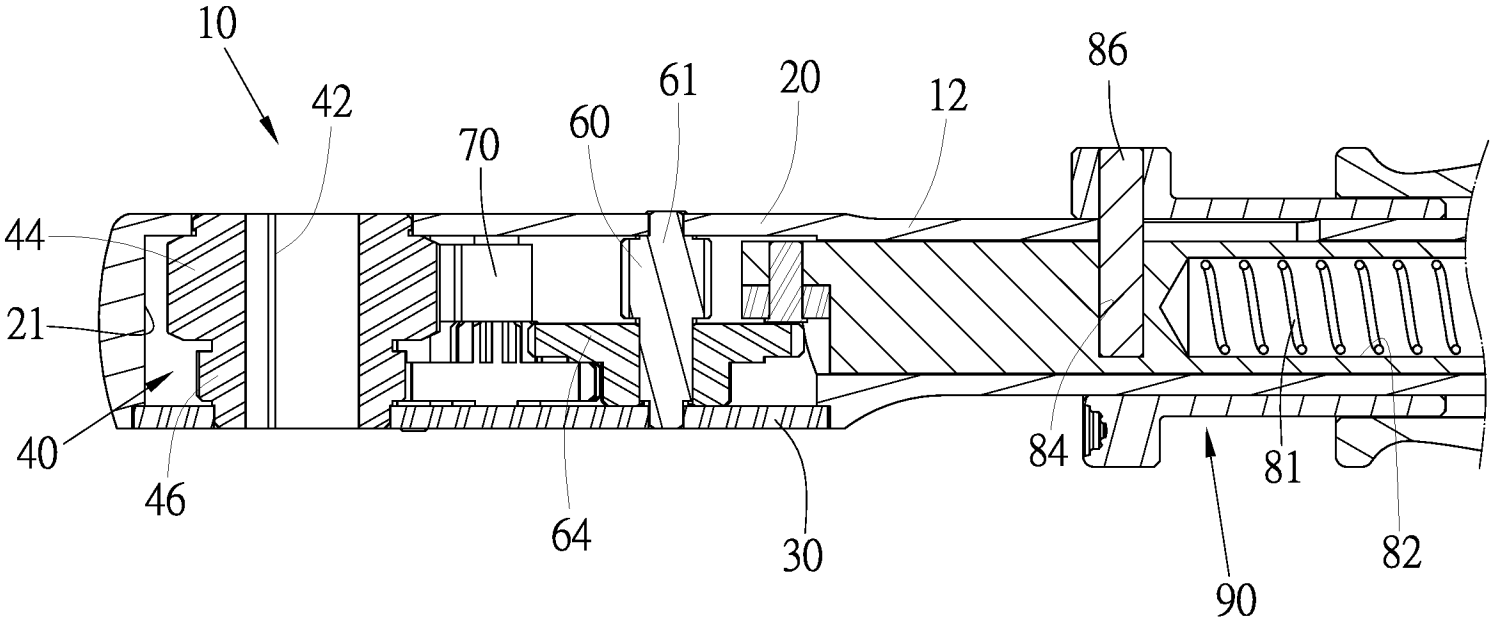
FIG. 4 is a cross-sectional view of the one-way wrench taken along a line A-A shown in FIG. 3.
Figure 5:
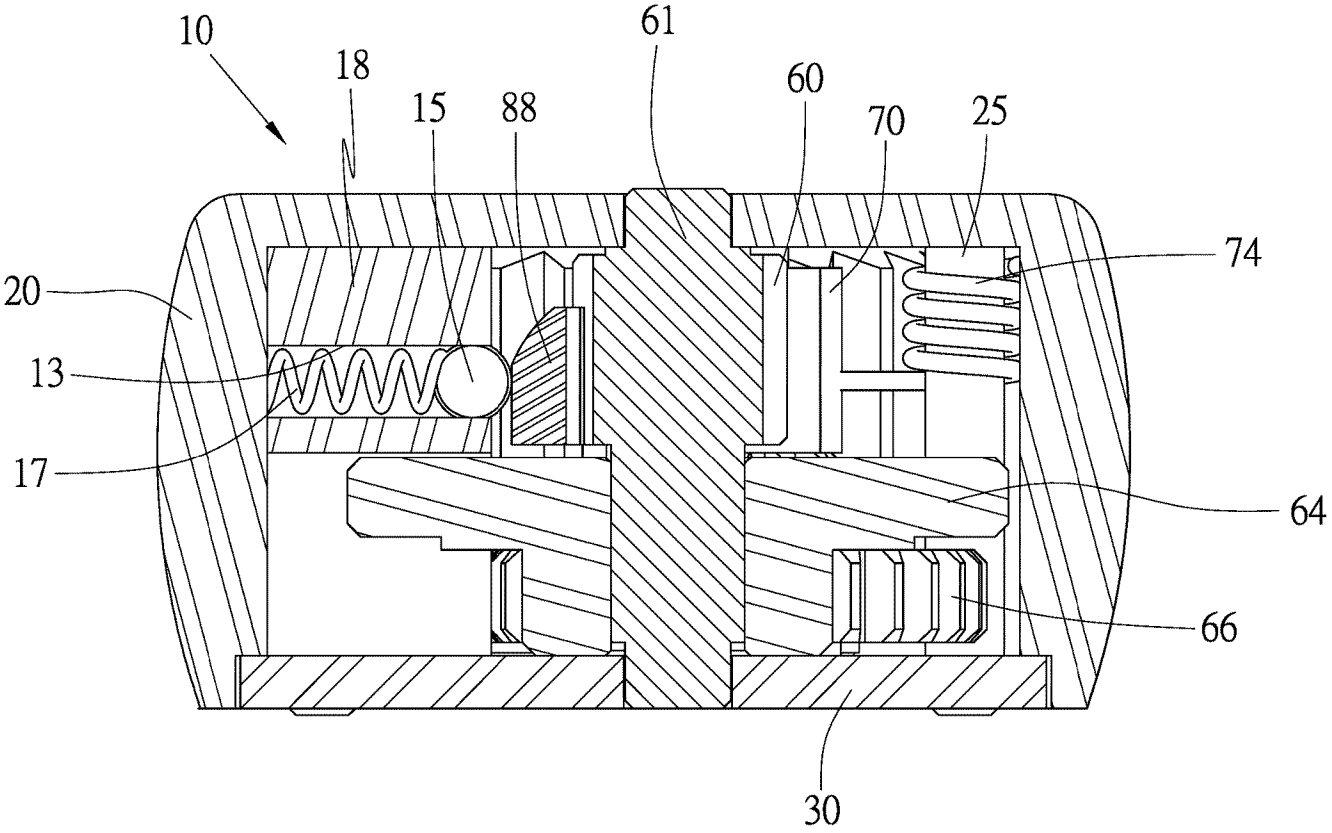
FIG. 5 is a cross-sectional view of the one-way wrench taken along a line B-B shown in FIG. 3.
Figure 6:
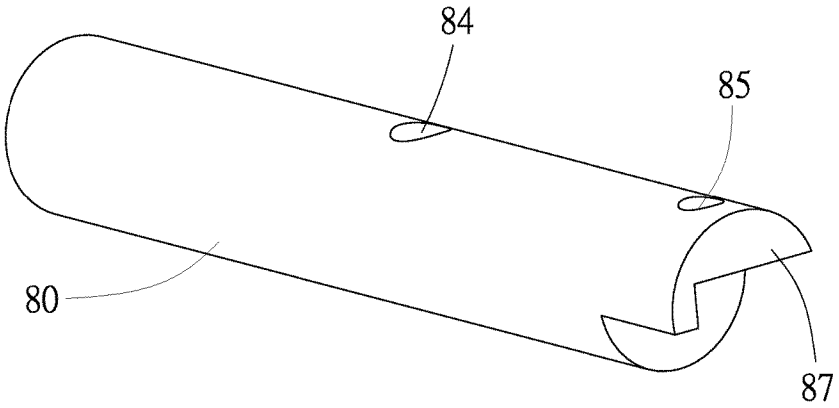
FIG. 6 is a perspective view of a rod of the one-way wrench shown in FIG. 1.
Figure 7:
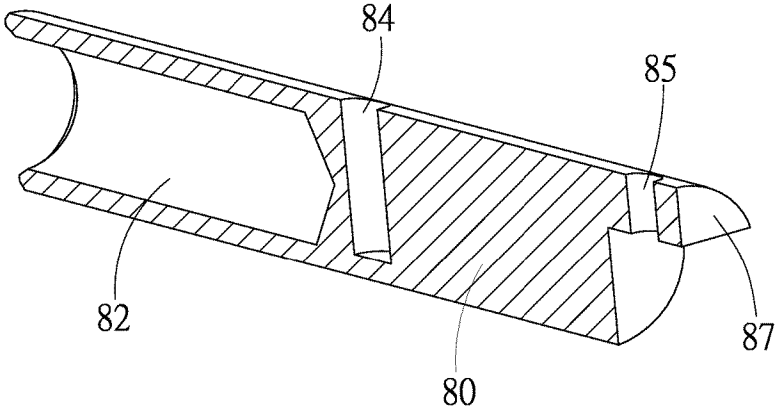
FIG. 7 is a cut-away view of the rod shown in FIG. 6.

Referring to FIGS. 1 through 2, the handle 10 includes a head 20 formed at an end of a shank 12. The shank 12 and the head 20 are made in one piece. The shank 12 is a circular tube that includes an axial tunnel 14 in communication with a longitudinal slot 16. The slot 16 extends much shorter than the tunnel 14.

The head 20 includes a chamber 21, an opening 22 and apertures 23, 24, 26 and 28. The chamber 21 is in communication with the tunnel 14. The opening 22 and the apertures 23, 24, 26 and 28 are in communication with the chamber 21. There are two apertures 24.

The cover 30 is shaped in compliance with the chamber 21. The cover 30 includes an opening 32 corresponding to the apertures 24, two screw holes 34 corresponding to the apertures 24, and apertures 36 and 38 corresponding to the apertures 26 and 28.

The toothed wheel 40 includes teeth 44. A gear 46 is connected to the toothed wheel 40 in a coaxial manner. The gear 46 and the toothed wheel 40 are preferably made in one piece. The toothed wheel 40 is made with a diameter larger than that of the gear 46. A square receptacle 42 axially extends throughout the toothed wheel 40 and the gear 46. The toothed wheel 40 can include a square insert instead of the square receptacle 42 in another embodiment.

The gear train includes four gears 60, 64, 65 and 66 and a rack 88. The gear 60 is made with a diameter smaller than that that of the gear 64. The gears 60 and 64 are provided on a shaft 61 so that they can spin together. The gears 60 and 64 and the shaft 61 are individual elements in this embodiment. The gears 60 and 64 and the shaft 61 can be made in one piece in another embodiment. The gear 65 is made with a diameter smaller than that of the gear 66. The gears 65 and 66 are provided on a shaft 63 so that they can spin together. The gears 65 and 66 and the shaft 63 can be individual elements or made in one piece.

The rack 88 is formed with a flat portion 89. A slot 76 is made in the flat portion 89 of the rack 88.

The rod 80 includes an axial bore 82 in an end, a transverse bore 84 made in the periphery, a tongue 87 extending from another end, and an aperture 85 made in the tongue 87. The tongue 87 is made with a planar face.

The driving element 90 includes an annular flange 94 formed on a tube 92. The tube 92 is made with an axial aperture 91. The annular flange 94 includes a radial aperture 96 in communication with the axial aperture 91.

The grip 98 includes an axial bore 93. The bore 93 includes a large portion 95 and a small portion 97. The large portion 95 of the bore 93 is made with a diameter larger than that of the small portion 97. The small portion 97 of the bore 93 is located deeper in the grip 98 than the large portion 95.

A detent 70 includes a tip (not numbered) and an aperture 72.

A spring 74 includes two rectilinear terminal portions extending from a helical middle portion. The spring 74 is a torque spring.

A positioning element 18 includes two portions extending perpendicular to each other. That is, the positioning element is a bent element. The positioning element includes a screw hole 11 and an aperture 13. The screw hole 11 extends perpendicular to the aperture 13.

In assembly, the rack 88 is movably inserted in the chamber 21 of the head 20 and the tunnel 14 of the shank 12. A portion of the rack 88 is inserted in the chamber 21 of the head 20 while another portion of the rack 88 is inserted in the tunnel 14 of the shank 12. The rack 88 is engaged with the gear 60.

The rod 80 is movably inserted in the tunnel 14 of the shank 12 so that the rod 80 can be reciprocated along the shank 12. The rack 88 is connected to and hence movable with the rod 80 by fitting a pin 83 in the aperture 85 of the rod 80 and inserting the pin 83 in the transverse slot 76 of the rack 88. The width of the transverse slot 76 is larger than the diameter of the pin 83 to allow the rack 88 to pivot relative to the rod 80. The transverse slot 76 extends perpendicular to the rod 80. The pin 83 can be replaced with a screw and the aperture 85 can be replaced with a screw hole in another embodiment.

The driving element 90 is movably provided on the shank 12. The driving element 90 is connected to the rod by inserting a pin 86 in the radial aperture 96 of the driving element 90 and the transverse bore 84 of the rod 80. The pin 86 extends through the slot 16. The diameter of the pin 86 is marginally smaller than the width of the slot 16 to render the pin 86 smoothly movable in the slot 16 without pivoting.

The grip 98 is fitted on the shank 12, i.e., the shank 12 is fitted in the small portion 97 of the bore 93 so that the grip 98 is not movable relative to the shank 12. The tube 92 is movable in the large portion 95 of the bore 93.

The spring 81 is a compression spring formed with an end inserted in the bore 82 of the rod 80 and another end inserted in the small portion 97 of the bore 93 of the grip 98. The spring 81 is compressed between the rod 80 and the grip 98. Thus, the spring 81 tends to bias the rod 80 toward the head 20.

The spring 81 is compressed when the driving element 90 is operated to move the rod 80 toward the grip 98. Accordingly, the tube 92 of the driving element 90 is moved in the large portion 95 of the bore 93 of the grip 98. The spring 81 pushes the rod 80 toward the head 20 when the driving element 90 is released.

The positioning element 18, the toothed wheel 40, the gears 60, 64, 65 and 66, the detent 70 and the spring 74 are inserted in the chamber 21 of the head 20 that is closed by the cover 30. The cover 30 is secured to the head 20 by inserting two screws 25 in the screw holes 34 via the apertures 24. Thus, the positioning element 18, the toothed wheel 40, the gears 60, 64, 65 and 66, the detent 70 and the spring 74 are retained in the chamber 21 of the head 20 by the cover 30.

The shaft 61 includes an end inserted in the second aperture 28 and another end inserted in the second aperture 38 to render the gears 60 and 64 smoothly rotatable in the head 20.

The gear 60 is engaged with the rack 88.

The shaft 63 includes an end inserted in the aperture 26 and another end inserted in the aperture 36 to render the gears 65 and 66 smoothly rotatable in the head 20. The gear 65 is engaged with the gear 64.

The toothed wheel 40 includes an end inserted in the opening 22 of the head 20 and another end inserted in the opening 32 of the cover 30 to render the toothed wheel 40 smoothly rotatable in the head 20. The gear 46 is engaged with the gear 66.

The shaft 63 is inserted in the aperture 72 of the detent 70 to allow the detent 70 to pivot to and fro. The spring 74 is located between the detent 70 and the head 20 to bias the detent 70 toward the toothed wheel 40 and hence keep the tip of the detent 70 in engagement with one of the teeth 44 of the toothed wheel 40. With the toothed wheel 40 and the detent 70, the head 20 rotates the toothed wheel 40 in a sense of direction, but the head 20 does not rotate the toothed wheel 40 in an opposite sense of direction. The spring 74 is kept in position by inserting one of the screws 25 in the helical portion thereof.

A ball 15 and a spring 17 are inserted in the aperture 13 of the positioning element 18. A portion of the ball 15 is located out of the aperture 13. A screw 19 is inserted in the screw hole 11 via the aperture 23 to retain the positioning element 18 in position in the chamber 21 of the head 20. Now, the aperture 13 includes an open end facing the rack 88 and another open end facing the head 20. An end of the spring 17 is placed against the head 20 while the portion of the ball 15 is placed against the rack 88. Thus, the spring 17 tends to keep the rack 88 engaged with the gear 60.

In use, an end of an extensive rod is inserted in the receptacle 42 of the toothed wheel 40 and another end of the extensive rod is inserted in a socket. The socket is provided on a nut or a head of a screw. In a first mode of operation, the driving element 90 is operated while the grip 98 is held in position.

Figure 10:
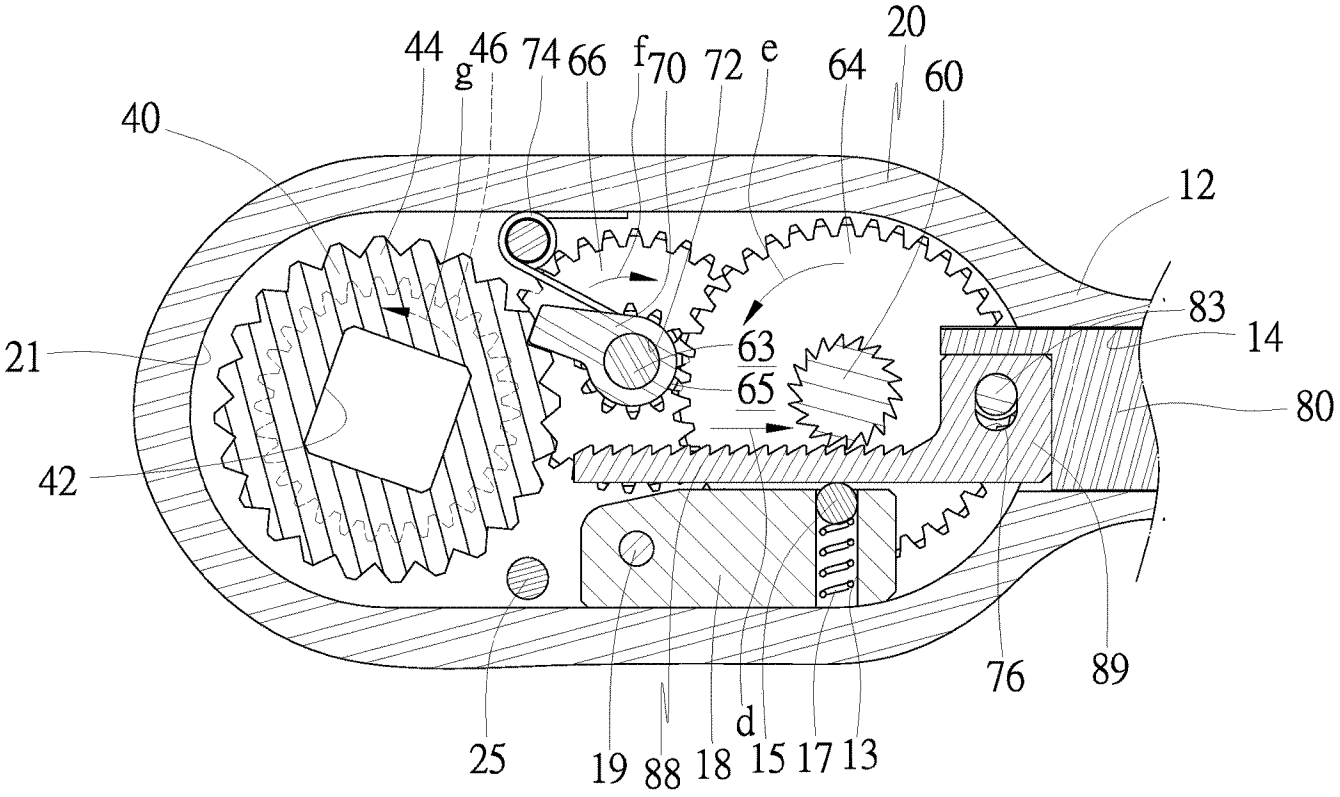
FIG. 10 is another cross-sectional and partial view of the one-way wrench shown in FIG. 1.

Referring to FIG. 10, the gear 60 is rotated as the rack 88 is moved away from the head 20 as indicated by an arrow head d. The ratchets of the rack 88 are engaged with the ratchets of the gear 60 so that the rack 88 spins the gear 60 as indicated by an arrow head e. The gear 64 spins the gear 65 as indicated by an arrow head f. The gear 66 spins the gear 46 as indicated by an arrow head g.

Figure 8:
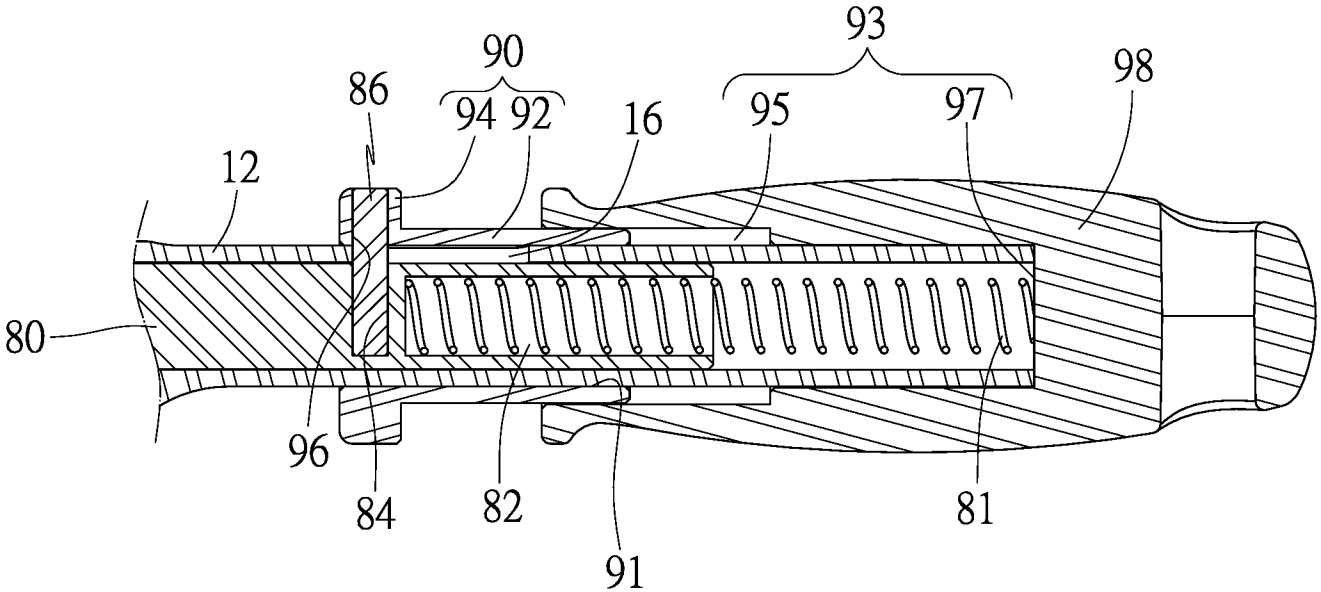
FIG. 8 is a cross-sectional and partial view of the one-way wrench shown in FIG. 1.
Figure 9:
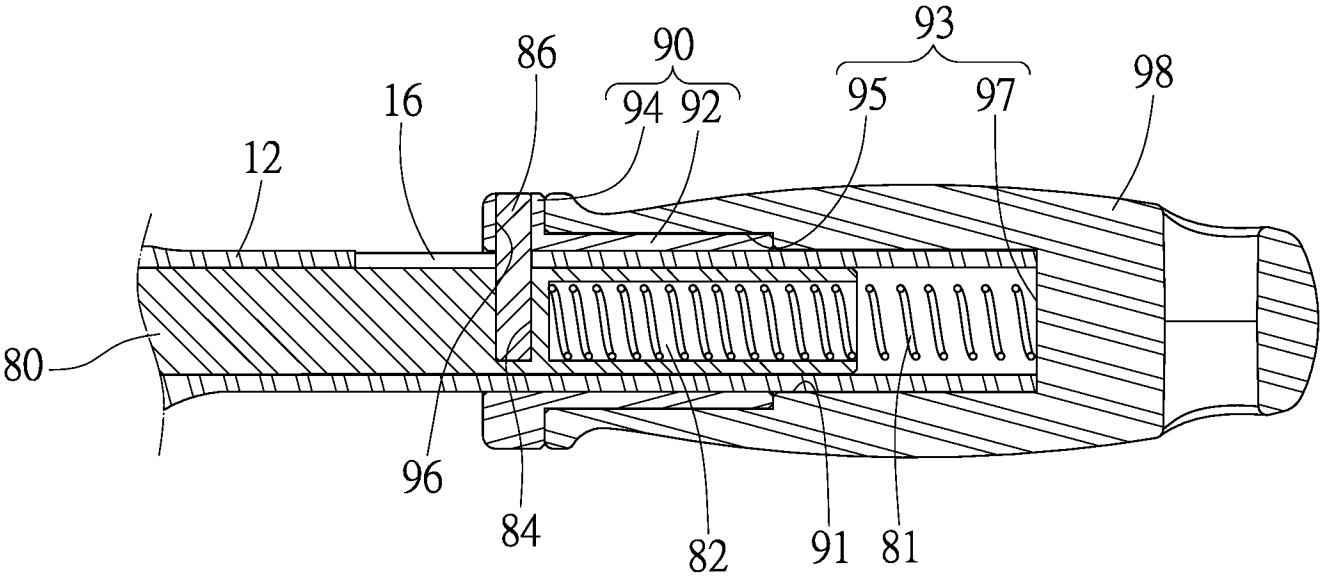
FIG. 9 is a cross-sectional and partial view of the one-way wrench in another position than shown in FIG. 8.

Referring to FIG. 9, the translation of the driving element 90 away from the head 20 is stopped when the pin 86 reaches a closed end of the slot 16. Then, the driving element 90 is released to allow the spring 81 to push the driving element 90 toward the head 20. Referring to FIG. 8, the translation of the driving element 90 toward the head is stopped when the pin 86 reaches another closed end of the slot 16.

Figure 11:
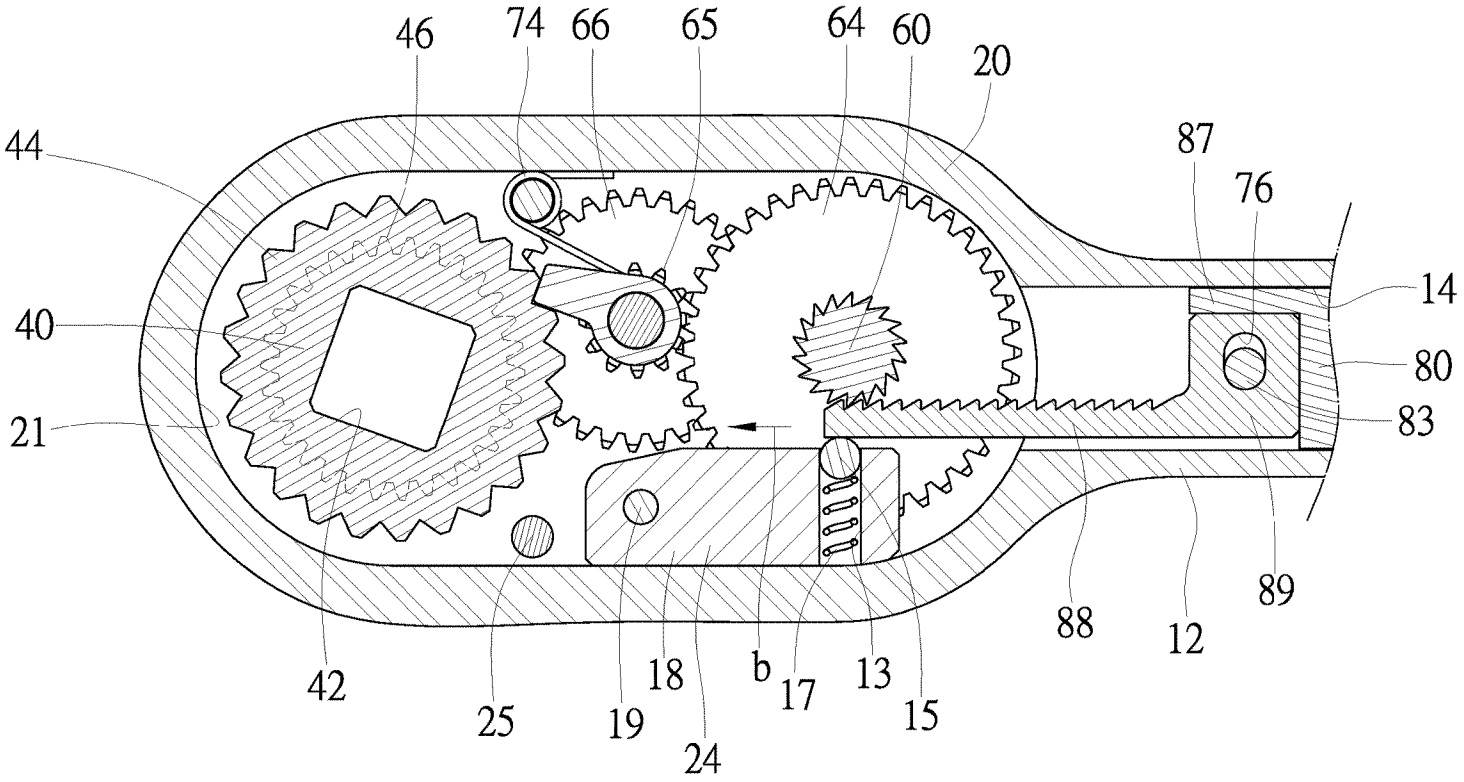
FIG. 11 is a cross-sectional and partial view of the one-way wrench in another position than shown in FIG. 10.
Figure 12:
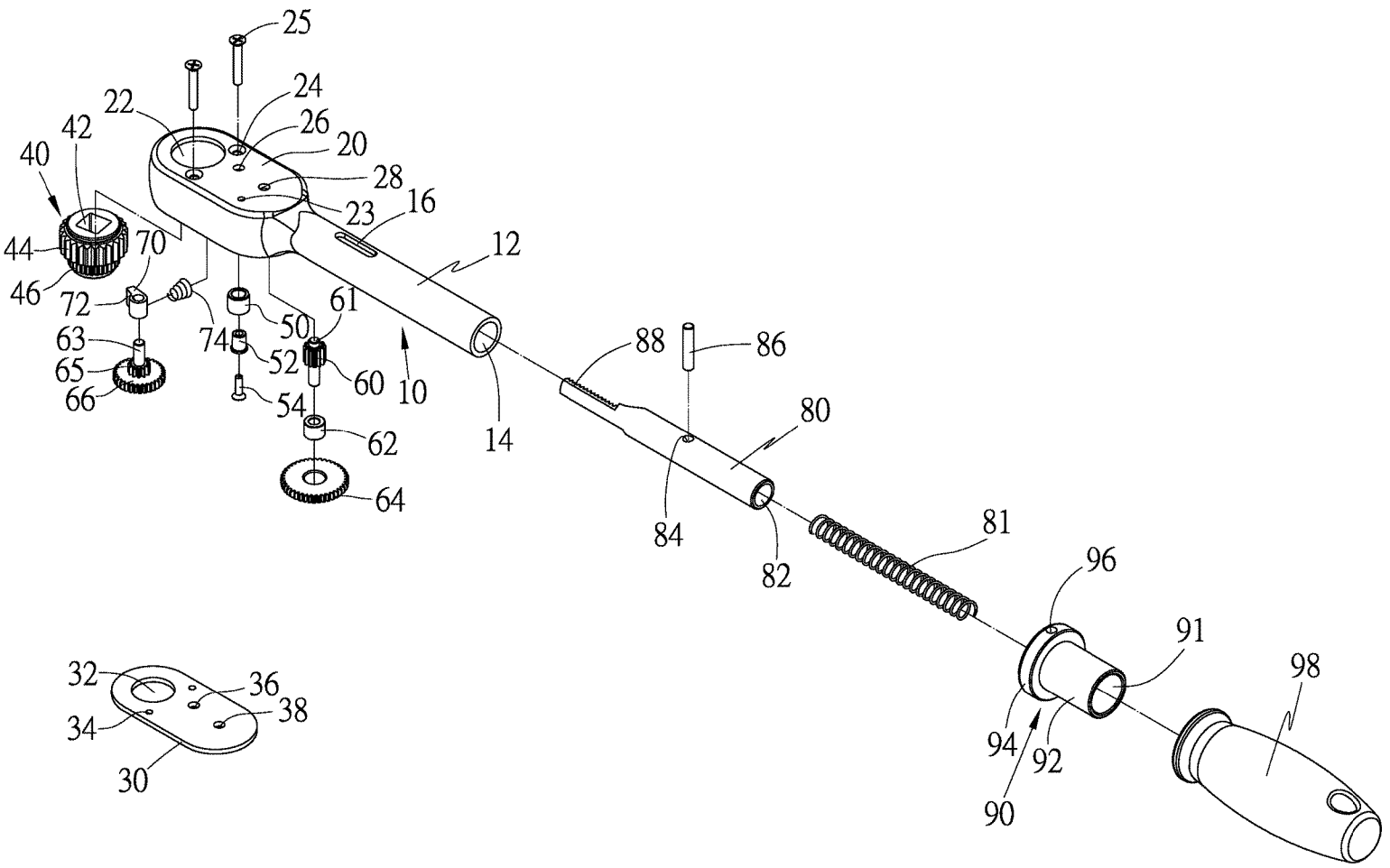
FIG. 12 is an exploded view of a one-way wrench according to the second embodiment of the present invention.
Figure 13:
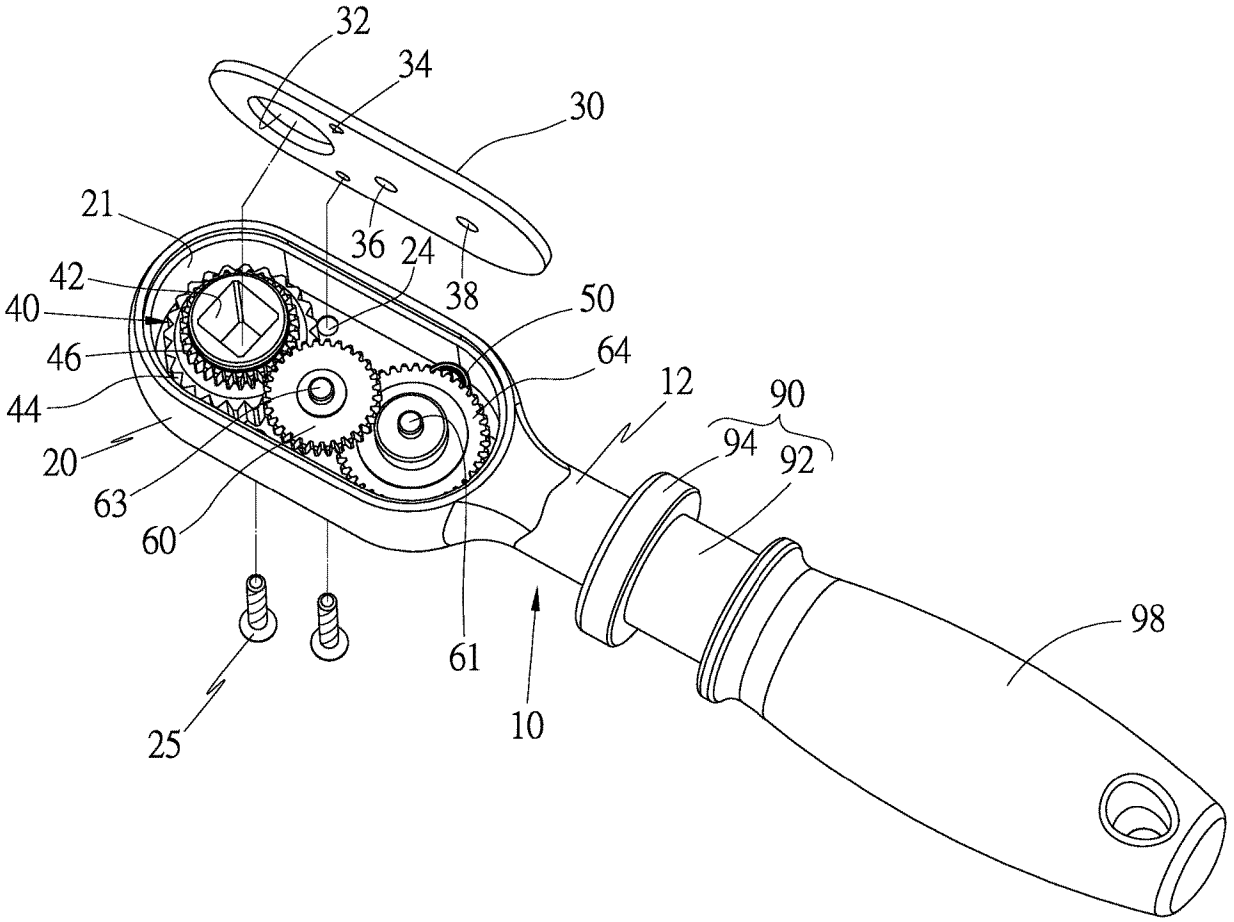
FIG. 13 is a partial view of the one-way wrench shown in FIG. 12.
Figures 9, 14:
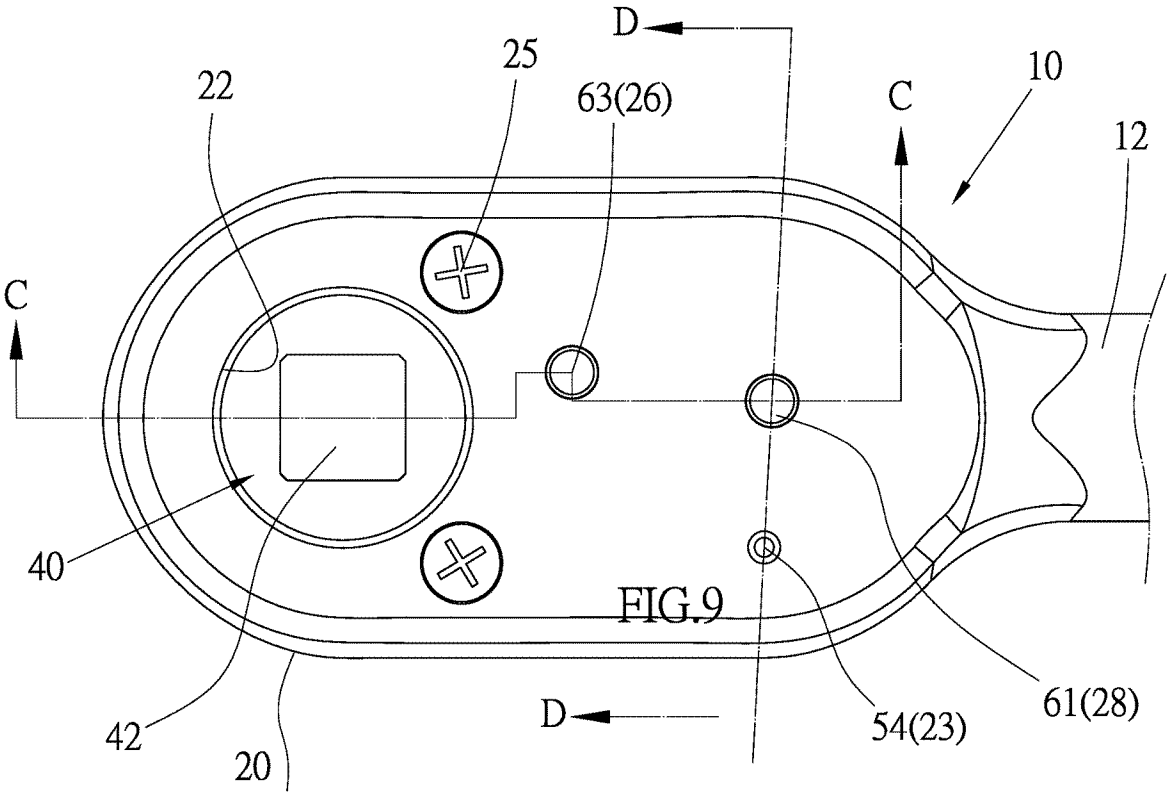
FIG. 14 is a top view of a head of the one-way wrench illustrated in FIG. 12.
Figure 15:
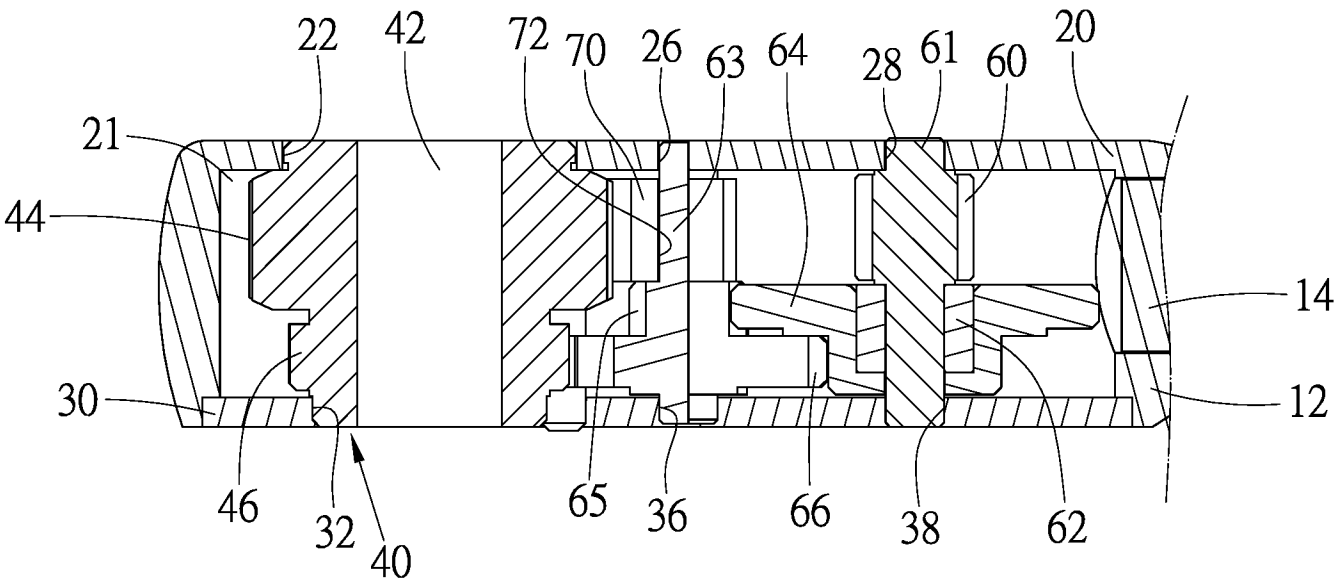
FIG. 15 is a cross-sectional view of the one-way wrench taken along a line C-C shown in FIG. 14.
Figure 16:
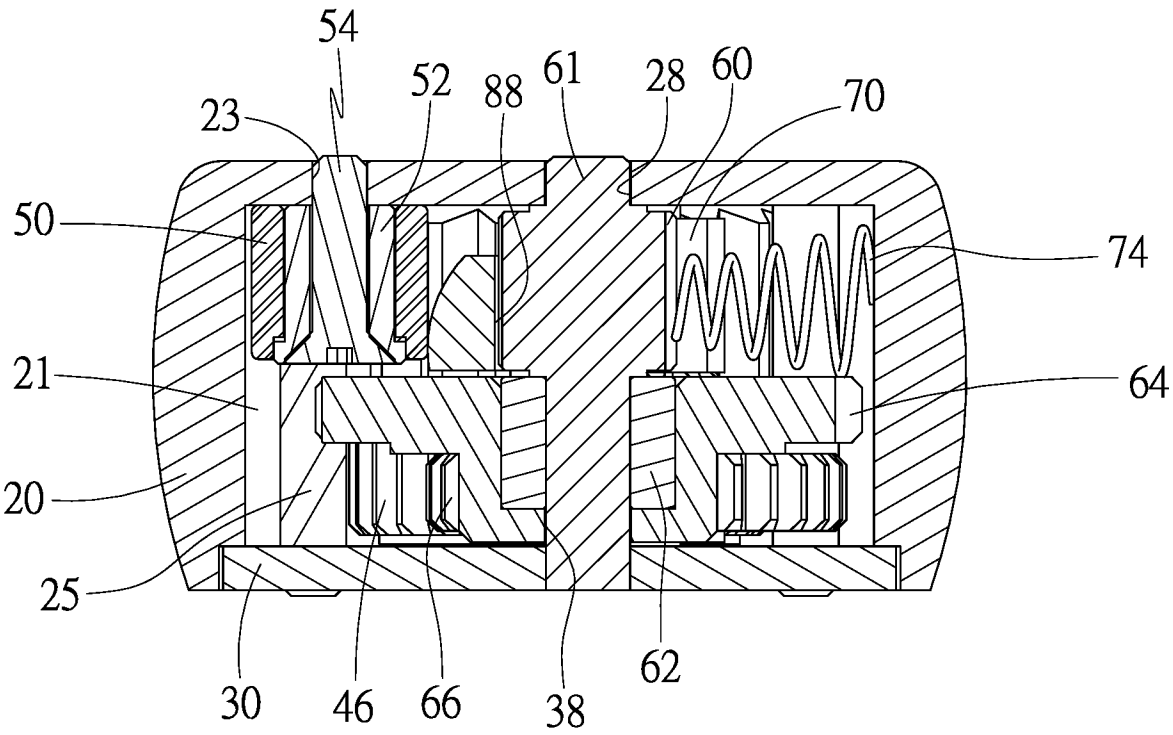
FIG. 16 is a cross-sectional view of the one-way wrench taken along a line D-D shown in FIG. 14.

Referring to FIG. 11, the gear 60 is not rotated when the rack 88 is moved toward the head 20 as indicated by an arrow head b. This is for two reasons. Firstly, the gear 60 is formed with ratchets, and so is the rack 88. Secondly, the pin 83 is movable in and along the transverse slot 76 to allow the rack 88 and the flat portion 89 of the rod 80 to be pushed away from the gear 60. That is, the rack 88 is disengaged from the gear 60. At the same time, the rack 88 pushes the entire ball 15 in the aperture 13 and hence compresses the spring 17. The spring 17 can return the rack 88 to engagement with the gear 60 via the ball 15.

The translation of the driving element 90 is reciprocated. The reciprocating of the driving element 90 is converted to the on-and-off rotation of the toothed wheel 40. The reciprocating of the driving element 90 imposes less stress in a user's wrist than rotation of a knob.

As described above, the rectilinear movement of the rack 88 is converted to the rotation of the toothed wheel 40. The numbers of the teeth of the rack 88 and the gears 60, 64, 65, 66 and 46 are chosen so that a stroke of the rectilinear movement of the rack 88 is converted to a revolve (360°) of the rotation of the toothed wheel 40. Hence, low torque is transmitted at high speed in the first mode.

In a second mode, referring to FIG. 10, the handle 10 is pivoted counterclockwise, and so are the head 20 and the detent 70. The tip of the detent 70 is engaged with one of the teeth 44 of the toothed wheel 40 so that the detent 70 and the head 20 rotate the toothed wheel 40 counterclockwise.

Referring to FIG. 11, the handle 10 is pivoted clockwise, and so are the head 20 and the detent 70. A screw or a nut engaged with a socket engaged with the toothed wheel 40 holds the toothed wheel 40 in position. The toothed wheel 40 does not rotate clockwise with the detent 70 and the head 20 because the tip of the detent 70 can be disengaged from the teeth 44 of the toothed wheel 40. Therefore, high torque is transmitted at low speed.

The one-way wrench can be inverted before the socket is engaged with the toothed wheel 40. Thus, the one-way wrench can be operated to rotate the screw or the nut clockwise but not counterclockwise.

Referring to FIGS. 12 to 18, there is a one-way wrench according to a second embodiment of the present invention. The second embodiment is identical to the first embodiment except for several things. Firstly, the rack 88 and the rod 80 are made in one piece. Hence, the tongue 87, the aperture 85, the flat portion 89 of the rack 88, the transverse slot 76 and the pin 83 are omitted.

Secondly, the rack 88 is placed against a roller 50 instead of the ball 15, the spring 17 and the positioning element 18. The roller 50 is provided on a shaft 54 via a bushing 52. The shaft 54 can be in the form of a screw inserted in the aperture 23 of the head 20. The rack 88 extends between the gear 60 and the roller 50. The roller 50 tends to keep the rack 88 engaged with the gear 60, but allows disengagement of the rack 88 to be from the gear 60.

Thirdly, the spring 74 is a compression spring instead of a torque spring. An end of the spring 74 can be secured to the head 20 by welding for example. Alternatively, the end of the spring 74 can be inserted in a dovetail groove made in the head 20 so that the spring 74 can be detached from the head 20.

Fourthly, the gear 64 is provided on the shaft 61 via a one-way bearing 62. Accordingly, the teeth of the rack 88 and the teeth of the gear 60 are ordinary teeth instead of ratchets. The one-way bearing 62 includes an internal portion provided on the shaft 61 and an external portion fitted in the gear 64. The gear 64 and the gear 60 are located side by side. Thus, the gear 60 rotates the gear 64 is a sense of direction but not in an opposite sense of direction.

Figure 17:
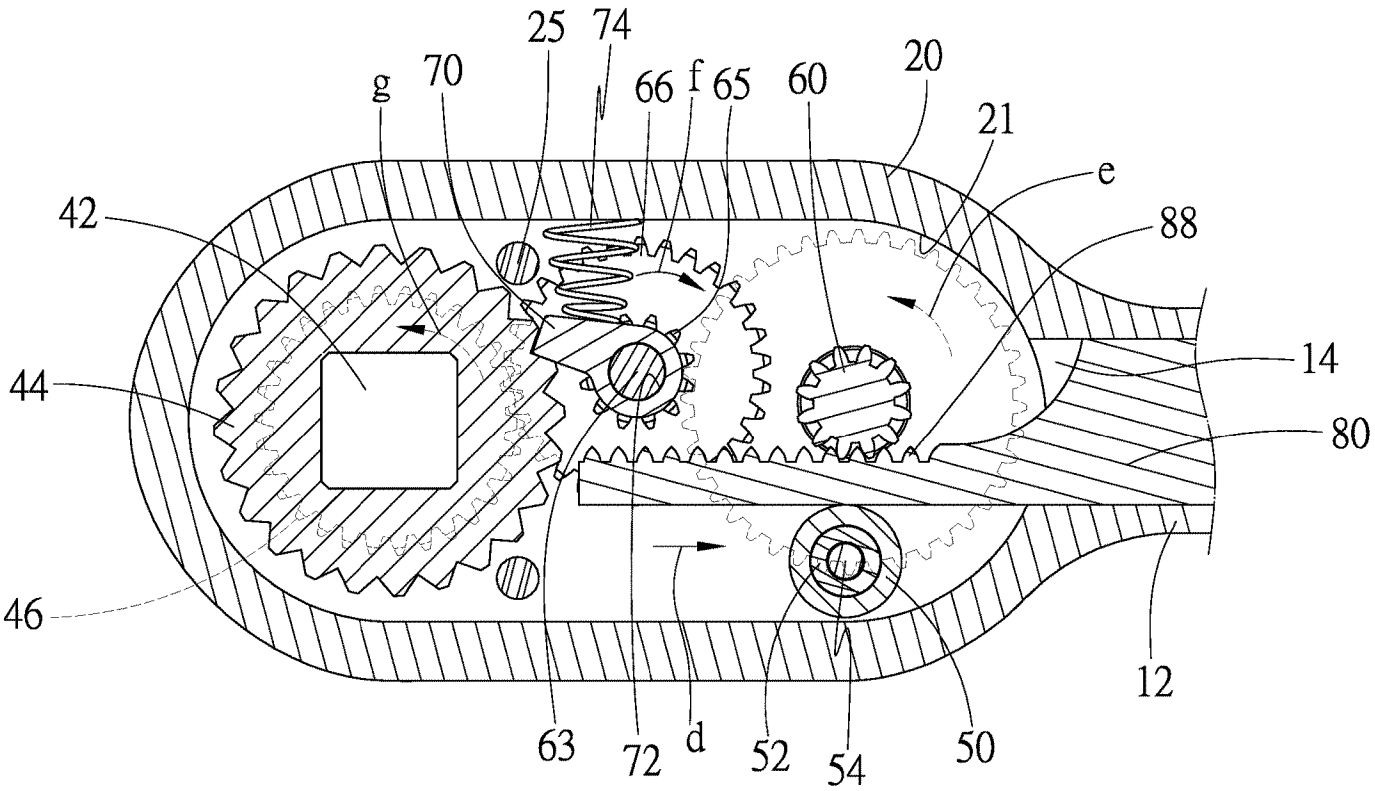
FIG. 17 is a cross-sectional and partial view of the one-way wrench shown in FIG. 12.

Referring to FIG. 17, the rack 88 is moved away from the head 20 as indicated by an arrow head d. Hence, the rack 88 rotates the gear 60 as indicated by an arrow head e. Due to the use of the one-way bearing 62 (FIG. 15), the gear 60 rotates the gear 64. The gear 64 rotates the gear 65 as indicated by an arrow head f. The gear 66 rotates the gear 46 as indicated by an arrow head g.

Figure 18:
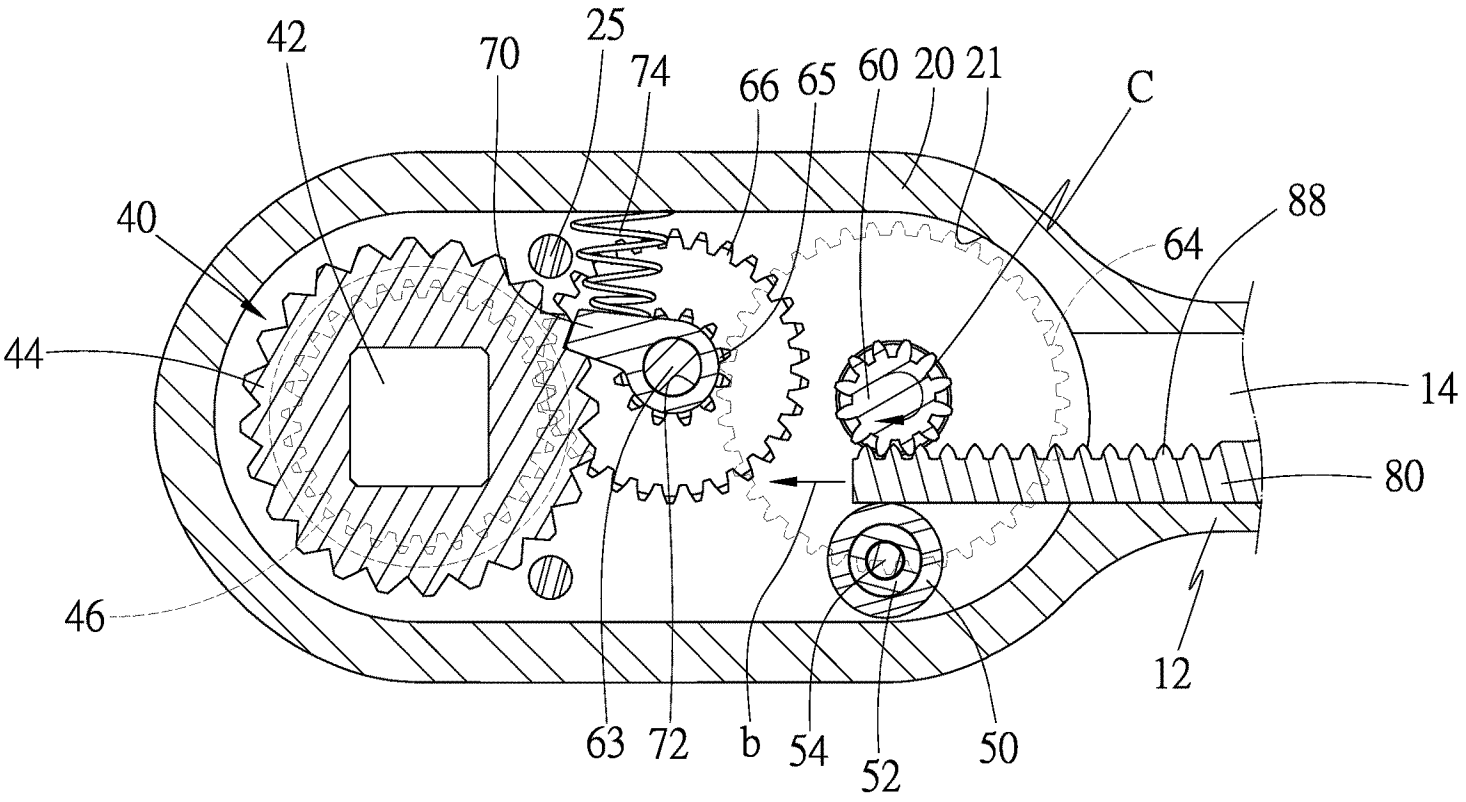
FIG. 18 is a cross-sectional and partial view of the one-way wrench in another position than shown in FIG. 17.

Referring to FIG. 18, the rack 88 is moved toward the head 20 as indicated by an arrow head b. Hence, the rack 88 rotates the gear 60 as indicated by an arrow head c. Due to the use of the one-way bearing 62 (FIG. 15), the gear 60 does not rotate the gear 64. Accordingly, the toothed wheel 40 is not rotated.

As described above, the reciprocating of the rack 88 is converted to the on-and-off rotation of the toothed wheel 40. Low torque is transmitted at high speed.

In another embodiment, the gear 46 can be directly engaged with the rack 88. Accordingly, the gears 60, 64, 65 and 66 are omitted.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A one-way wrench comprising:

a handle comprising:

a shank comprising a tunnel extending in a longitudinal direction thereof; and a head formed at an end of the shank and made with a chamber in communication with the tunnel;

a toothed wheel rotationally inserted in the chamber of the head;

a detent pivotally connected to the head and elastically engaged with the toothed wheel so that the head rotates the toothed wheel in a one-way manner;

a rod movable in the tunnel of the shank in a reciprocated manner; and a gear train arranged between the rod and the toothed wheel to convert the reciprocating of the rod to on-and-off rotation of the toothed wheel, wherein the gear train comprises:

a rack longitudinally connected to the rod and formed with ratchets and a transverse slot;

a pin connected to the rod and inserted in the transverse slot of the rack;

a first gear coaxially connected to the toothed wheel;

a last gear connected to the first gear and formed with ratchets engaged with the ratchets of the rack;

a spring for biasing the rack toward the last gear; and a ball provided between the spring and the rack to reduce friction between the spring and the rack.

2. The one-way wrench according to claim 1, wherein the gear train further comprises:

a second gear engaged with the first gear;

a third gear coaxially connected to the second gear; and a fourth gear engaged with the third gear;

wherein the last gear is coaxially connected to the fourth gear at an end and engaged with the rack at another end.

3. The one-way wrench according to claim 2, wherein the gear train further comprises a shaft coaxially connected to the last gear and a one-way bearing provided between the shaft and the fourth gear.

4. The one-way wrench according to claim 3, wherein the gear train further comprises a roller for pressing the rack against the last gear.

5. The one-way wrench according to claim 1, wherein the gear train further comprises a positioning element for keeping the ball and the spring in position.

6. The one-way wrench according to claim 5, wherein the positioning element comprises an aperture for receiving the ball and the spring.

7. The one-way wrench according to claim 1, wherein the detent comprises an aperture for receiving a shaft that is connected to the head.

8. The one-way wrench according to claim 1, further comprising a spring for biasing the detent toward the toothed wheel.

9. The one-way wrench according to claim 8, wherein the spring is a torque spring.

10. The one-way wrench according to claim 8, wherein the spring is a compression spring.

11. The one-way wrench according to claim 1, wherein the shank further comprises a slot in communication with the tunnel, wherein the rod comprises a transverse bore and a pin inserted in the transverse bore via the slot, wherein the movement of the rod is restrained as movement of the pin is limited by two closed ends of the slot.

12. The one-way wrench according to claim 11, further comprising a driving element movably provided on the shank and made with a radial aperture for receiving the pin so that the driving element is connected to the rod by the pin.

13. The one-way wrench according to claim 12, further comprising a grip connected to the shank and a spring compressed between the grip and the rod.

14. The one-way wrench according to claim 13, wherein the rod comprises a bore for receiving an end of the spring, wherein the grip comprises a bore for receiving another end of the spring.

15. The one-way wrench according to claim 14, wherein the bore of the grip comprises a small portion for tightly receiving the shank and a large portion for movably receiving the driving element.

* * * * *